US006113313A

United States Patent [19]

Blair et al.

[11] Patent Number: 6,113,313

[45] **Date of Patent: *Sep. 5, 2000**

[54] PILE WRAPPER AND CLAMPING ASSEMBLY

[75] Inventors: Russell M. Blair, Westport; Anthony E. J. Strange, Southbury, both of Conn.

[73] Assignee: Slickbar Products Corporation, Seymour, Conn.

[ * ] Notice: This patent is subject to a terminal disclaimer.

[21] Appl. No.: 09/164,797

[22] Filed: Oct. 1, 1998

Related U.S. Application Data

[63] Continuation-in-part of application No. 08/661,556, Jun. 11, 1996, Pat. No. 5,816,746.

[51] Int. Cl.[7] ..... E02D 5/60; E02D 31/06

[52] U.S. Cl. ..... 405/216; 405/211.1

[58] Field of Search ..... 405/211, 211.1, 405/212, 216; 24/460

[56] References Cited

U.S. PATENT DOCUMENTS

| | | | |
|---|---|---|---|
| 1,012,486 | 12/1911 | Weber | 24/460 X |
| 3,890,795 | 6/1975 | Maurer | 405/216 |
| 3,996,757 | 12/1976 | Liddell | 405/216 |
| 3,999,399 | 12/1976 | Maurer | 405/215 |
| 4,107,826 | 8/1978 | Tysdal | 24/460 |
| 4,295,756 | 10/1981 | Blair | 405/70 |
| 4,445,806 | 5/1984 | Crain | 405/216 |
| 5,079,805 | 1/1992 | Mlachnik | 411/400 X |
| 5,102,265 | 4/1992 | Dokmo et al. | 405/216 |
| 5,203,055 | 4/1993 | Broadwater | 24/462 |
| 5,226,751 | 7/1993 | Doleshal | 405/216 X |
| 5,435,667 | 7/1995 | Strange | 405/216 |

FOREIGN PATENT DOCUMENTS

| | | |
|---|---|---|
| 838594 | of 1960 | United Kingdom . |
| 9204504A | of 1992 | WIPO . |
| 9321392A | of 1993 | WIPO . |

OTHER PUBLICATIONS

NICC Systems literature (Autumn 1993): Armawrap (4 pages) including Bibliography of Armawrap Development. Low Profile Armawrap (2 pages).

Retrowrap (2 pages).

*Primary Examiner*—Eileen D. Lillis
*Assistant Examiner*—Tara L. Mayo
*Attorney, Agent, or Firm*—Ware Fressola Van Der Sluys & Adolphson LLP

[57] ABSTRACT

A pile wrapper closure assembly includes a pair of clamping bars each having a retaining groove with an undersized throat portal opening, and a pair of retaining rods. Each retaining rod secures one end of the pile wrapper in the retaining groove of its respective clamping bar so that the joining of the clamping bars stretches the pile wrapper elastically around a pile to prevent exposure of the pile to water and air. The pile wrapper has a porous pile-facing interior layer impregnated with a biocidal, corrosion-inhibiting gel. One or more compressible felt pads or strips are saturated with the gel and bonded to the interior layer and they are compressed to fill any void between the pile and the wrapper ends when these are clamped between the clamping bars.

5 Claims, 5 Drawing Sheets

PILE WRAPPER AND CLAMPING ASSEMBLY

CROSS-REFERENCE TO RELATED APPLICATION

This application is a continuation-in-part of U.S. patent application Ser. No. 08/661,556 filed Jun. 11, 1996, issued as U.S. Pat. No. 5,816,746 on Oct. 6, 1998.

BACKGROUND OF THE INVENTION

The present invention generally relates to a pile wrapper closure assembly, and in particular, it relates to one such pile wrapper closure assembly including first and second grooved connector channels or clamping bars, continuously attachable, to first and second edge ends of the pile wrapper respectively, in heat-sealed full length pockets or merely by wrapping, which are then clamped together to secure the pile wrapper around the pile to prevent the pile from being exposed to water or air.

The use of pile wrappers to protect piles from marine life, decay and corrosion is well known in the industry, particularly in oil rig, pier and jetty applications. Although newer piles are sometimes made from materials which are less susceptible to corrosion and marine borer attack, nevertheless, thousands of unprotected piles have been in place for years and are continuously subjected to corrosive elements in intertidal and splash zones.

One type of pile wrapper is the permanent type which is typically cast from cement or other material. However, this approach can be expensive for piles which are submerged in water. Moreover, such permanent wrappers make future inspection difficult and cannot be reused if removed.

More recently, simpler wrapper techniques have replaced the permanent approaches. In general these techniques involve securing a flexible metal or plastic sheath around the pile which can later be removed for inspection and even reused. This approach avoids the use of elaborate molds or castings and often continues to provide protection even if punctured. These wrappers typically are stretched around the pile and the two opposing ends joined with fastening devices to hold the wrapper in place. The wrapper ends often include handles or latching devices to facilitate joining the ends. Alternatively, some wrappers incorporate a rod or dowel which is sealed in a pocket at one or both ends. The wrapper is then drawn around the pile and the encased dowels held by latches to seal the ends of the wrapper. However, this technique requires that a wrapper be sized for a particular pile and limits its reusability. Moreover, since the joining device is attached to the wrapper, it cannot be used on a different wrapper. Finally, a supplemental section of wrapper is often required underneath the junction of the wrapper ends to provide a watertight seal.

Consequently, a removable and reusable pile wrapper closure assembly for securing a pile wrapper to a pile which provides a watertight seal without the use of supplemental sealing material is highly desirable.

SUMMARY OF THE INVENTION

The present invention is designed to overcome the limitations discussed above and towards that end it includes a novel pile wrapper closure assembly which is inexpensive and simple to manufacture, provides a watertight and airtight seal over a long service life, and is fully adjustable, removable and reusable. The assembly includes first and second clamping bars, first and second retaining rods and joining means for aligning and joining the first and second clamping bars.

The first and second retaining rods are adapted for endwise sliding engagement in narrow-mouthed grooves formed in the first and second clamping bars so as to clamp first and second ends of the pile wrapper. The first and second clamping bars are then drawn together with the joining means so as to secure the pile wrapper around the pile and clamp the first and second pile wrapper ends together to form a watertight and airtight seal to prevent the pile from being exposed to water or air.

Advantages of the present pile wrapper closure assembly over the prior art will become apparent to those skilled in the art from the following detailed description read in conjunction with the appended claims and drawings attached hereto.

BRIEF DESCRIPTION OF THE DRAWINGS

The drawings, not drawn to scale, include.

DESCRIPTION OF THE PREFERRED EMBODIMENT

Figure 1:
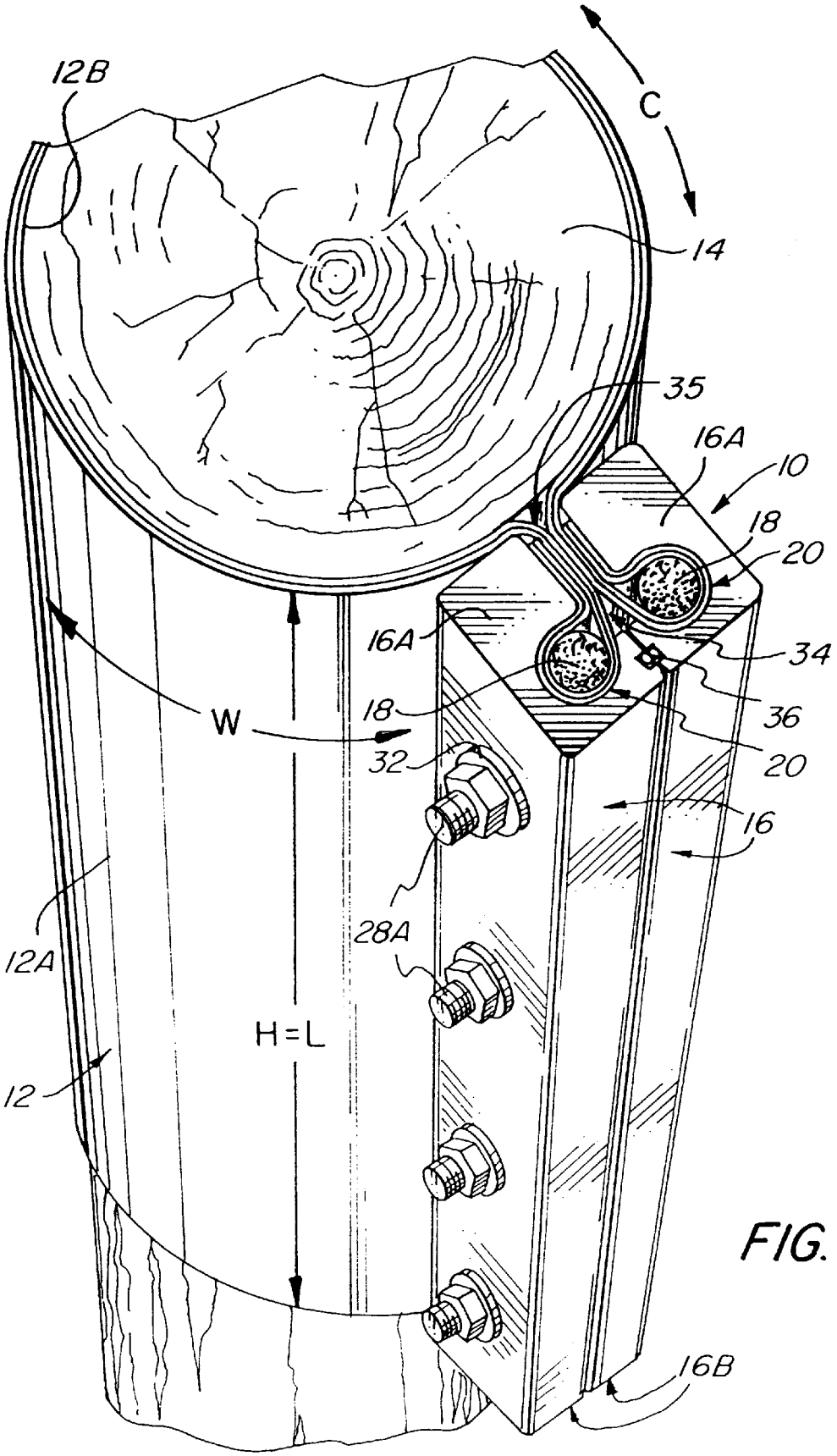
FIG. 1, which is a perspective view of a pile wrapper closure assembly of the present invention.

A pile wrapper closure assembly, generally indicated at 10 in FIG. 1 and embodying the principles of the present invention, is illustrated attached to pile wrapper 12 which has been installed around pile 14. Although illustrated as round, pile 14 may be rectangular, polygonal or other shape and may be made from a variety of materials such as metal, wood, concrete or other suitable material.

The pile wrapper 12 is an elastomeric sheet which may include an outer skin 12A of water impermeable flexible elastic polymer material having a woven reinforcing fabric embedded therein, and an inner layer 12B of liquid permeable material. The outer skin 12A may include a cathodic protection system providing a carrier for sacrificial anode material and may be coated with a marine fouling release additive or coating. On the other hand, the liquid permeable material of the inner layer 12B may be of felt, impregnated with a gel of water resistant sealant incorporating both corrosion inhibiting and biocidal components as well. However, it is desirable that the pile wrapper 12 not be permanently bonded to pile 14 so that the pile wrapper 12 may be removed to facilitate inspection of the pile.

Figure 2:
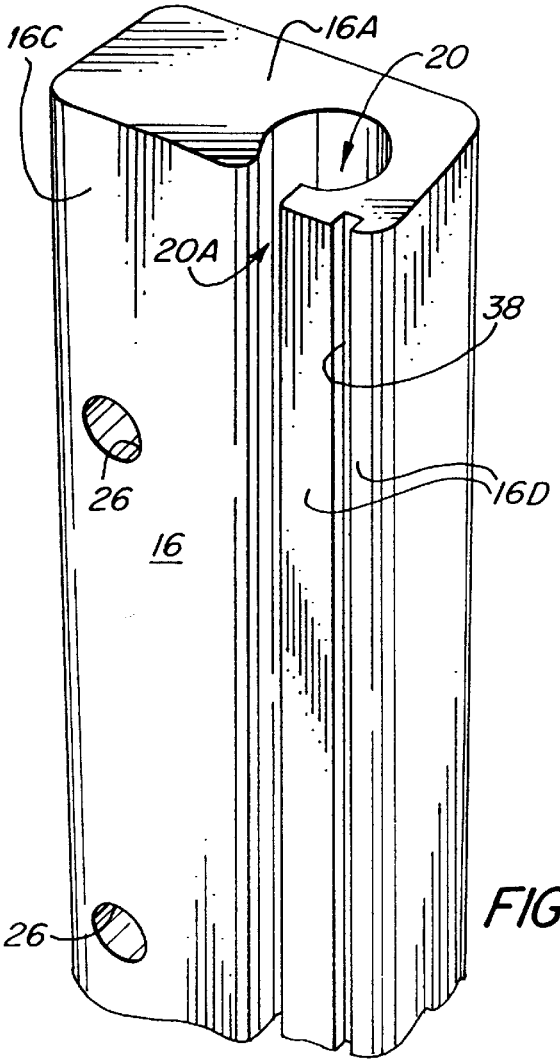
FIG. 2, which is a partial perspective view of one of the clamping bars illustrated in FIG. 1.

The pile wrapper closure assembly 10 includes a pair of clamping connector channels or grooved clamping bars 16 and a pair of retaining rods 18. As best illustrated in FIG. 2, each of the clamping bars 16 is generally rectangular in shape and includes a first end 16A, a second end 16B, a first inner face 16C and a second inner face 16D. The clamping bars 16 may be made from treated or coated metal, plastic, composite or other material suitable for a highly corrosive environment, such as extruded aluminum or extruded rigid polyvinyl chloride. However, a material should be selected so that the clamping bars 16 are sufficiently rigid, and do not significantly deform or flex when drawn together under the high tension required during installation of a pile wrapper.

Figure 2A:
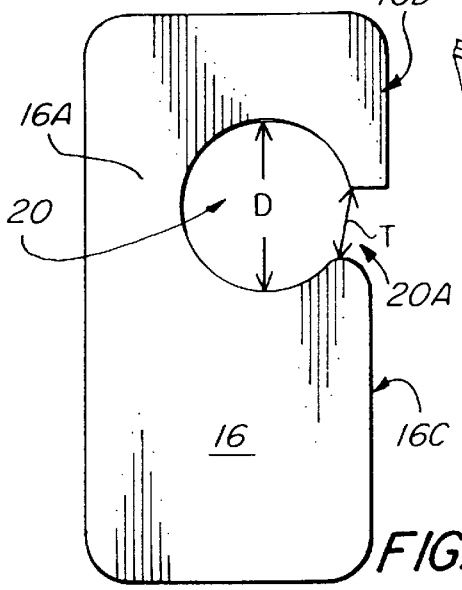
FIG. 2A, which is an end view of the clamping bar of FIG. 2.

Each clamping bar 16 includes a retaining groove 20 which extends from the first end 16A to the second end 16B. Each retaining groove 20 is located off center and is generally circular in shape, narrowing to a smaller throat opening 20A (FIGS. 2, 2A) at the junction of the first and second inner faces 16C,16D. As illustrated in FIG. 2A, the size of the throat opening T is smaller than the diameter of rod 18, and considerably smaller than the diameter D of the retaining groove 20. Also, each first inner face 16C is slightly recessed from its adjacent second inner face 16D to provide sufficient space for the pile wrapper 12 ends when they are compressed between the first inner faces 16C. As best illustrated FIG. 4, the size and shape of each retaining groove 20 is selected to slidably receive and hold the corresponding retaining rod 18 when the retaining rod 18 is held in an elongated passage 22 formed inside a pocket 12B or wrapped in one end edge of the pile wrapper 12. Specifically, each wrapped retaining rod 18 may be telescopingly inserted and slidably engaged with its corresponding retaining groove 20 from either the first end 16A or the second end 16B of the clamping bar 16, and once engaged, cannot be separated from its respective clamping bar 16 in any other direction, especially in a sideways direction.

Figure 3:
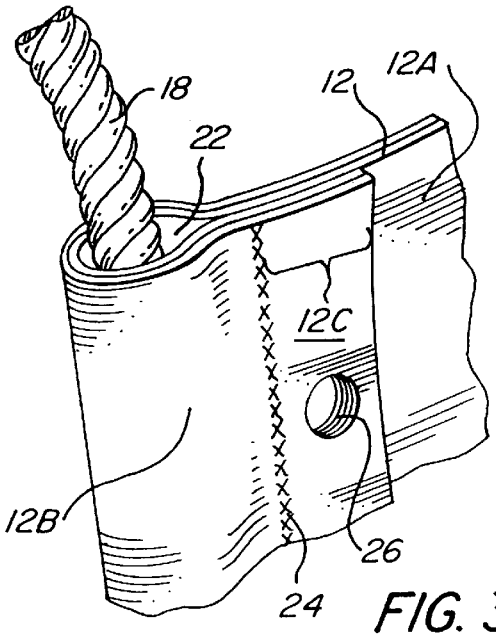
FIG. 3, which is a partial perspective view of one end of the pile wrapper of FIG. 1.
Figure 4:
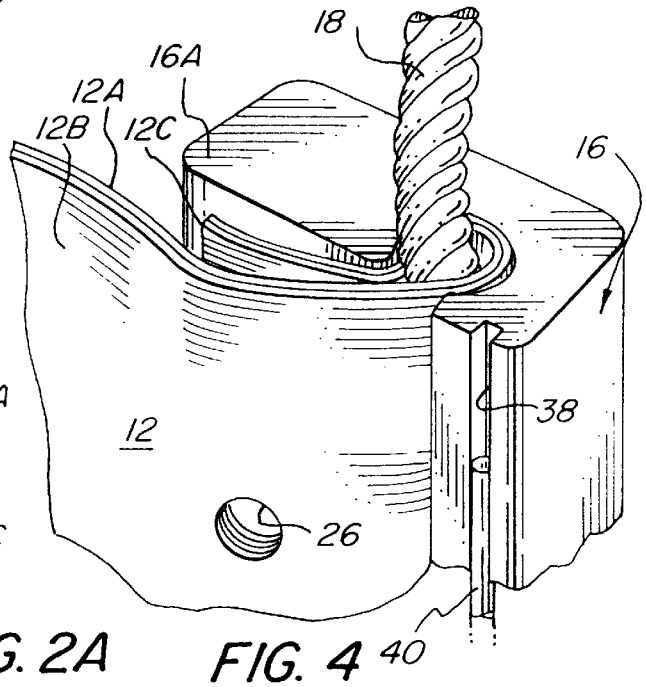
FIG. 4, which is a partial perspective view of the pile wrapper end of FIG. 3 installed in the clamping bar of FIG. 2.

The retaining rods 18 are illustrated as a twisted steel cable or "wire rope" in FIGS. 3 and 4. However, as would be appreciated by one skilled in the art, the retaining rods 18 could instead be a solid rod made of metal, wood, fiberglass reinforced plastic or other suitable material. The diameters of the retaining rods 18 are selected so that when pocketed or wrapped in the pile wrapper 12 they will slidably engage the retaining grooves 20 of their respective clamping bars 16 when inserted from either the first or second end 16A,16B. Unlike other arrangements which only support a pile wrapper at a few points, the assembly 10 of the present invention evenly distributes the tension along the entire length of the clamping bar 16 and retaining groove 20, which is particularly important during installation of a pile wrapper.

Securing a pile wrapper to a pile using the pile wrapper closure assembly 10 of the present invention involves several steps. First, the total circumferential wrapping width W of wrapper 12 is selected to assure that the elastically stretched wrapper 12 will be tautened after installation to a circumferential tensile stress of about 10% its breaking stress. Then, as illustrated in FIG. 3, each of the free end edges of the pile wrapper 12 are wrapped around one of the retaining rods 18 so that the pile wrapper 12 is folded back onto itself to form an overlap portion 12C creating elongated passage 22. As also shown in FIG. 3, a heat-sealed pocket 12B for receiving the retaining rod 18 may be formed by sealing the overlap portion 12C to the pile wrapper 12 at a sealing zone 24. The overlap portion 12C may thus be bonded to the pile wrapper 12, or may simply be allowed to rest against the pile wrapper 12. As illustrated in FIG. 4, the retaining rod 18 wrapped in the pile wrapper 12 is slid telescopingly endwise into the retaining groove 20 from either the first or second end 16A,16B of its respective clamping bar 16.

Each clamping bar 16 is provided with apertures 26 for receiving draw bolts 28 which are secured with nuts 30 and washers 32. As would be appreciated by one skilled in the art, the draw bolts 28 may be threaded rods instead of bolts, with washer and clamping nut assemblies mounted at each end for torquing. Apertures 26 are positioned between the pile and the retaining groove, and also provided in the free end edges of the pile wrapper 12, and after being fitted around the retaining rods 18, correspond in alignment with the apertures 26 in the clamping bars 16. Although the ends of the pile wrapper 12 are securely held in the retaining grooves 20 by the retaining rods 18, the draw bolts 28 will also hold the pile wrapper 12 in place so that it doesn't slip.

After the pile wrapper 12 has been wrapped around the pile 14, the clamping bars 16 are oriented so that their inner faces 16C,16D are in an opposed, spaced apart relationship. Next, the draw bolts 28 are inserted into the apertures 26, as shown in FIG. 5, to secure the clamping bars 16 in the opposed spaced apart relationship with their inner faces 16C,16D facing each other.

Figure 6:
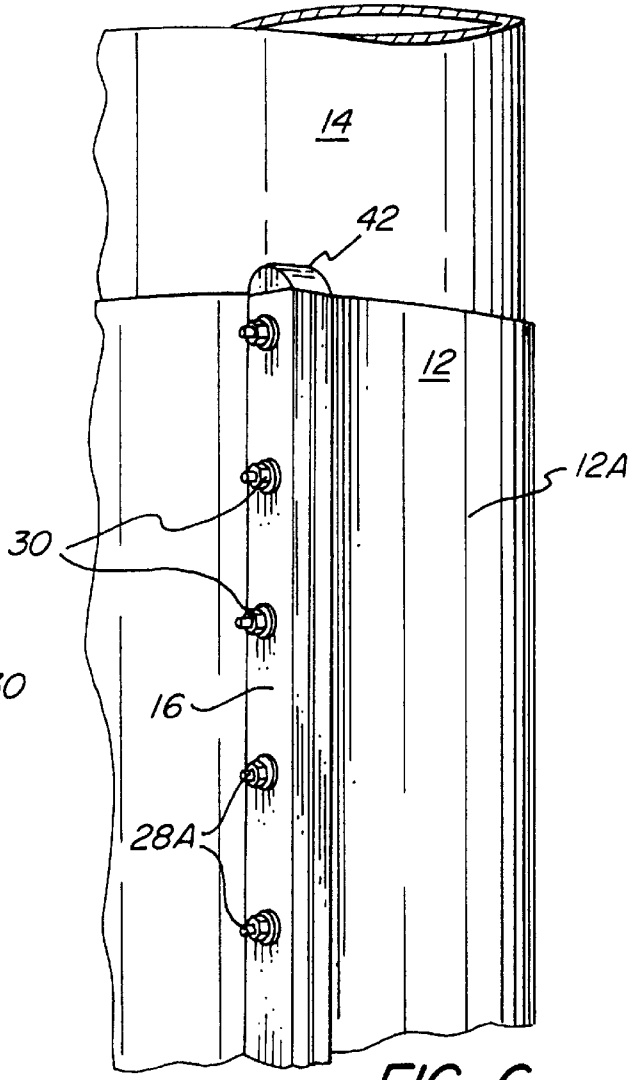
FIG. 6, which is a partial perspective view of the pile wrapper closure assembly of FIG. 5 fully installed on a pile.
Figure 8:
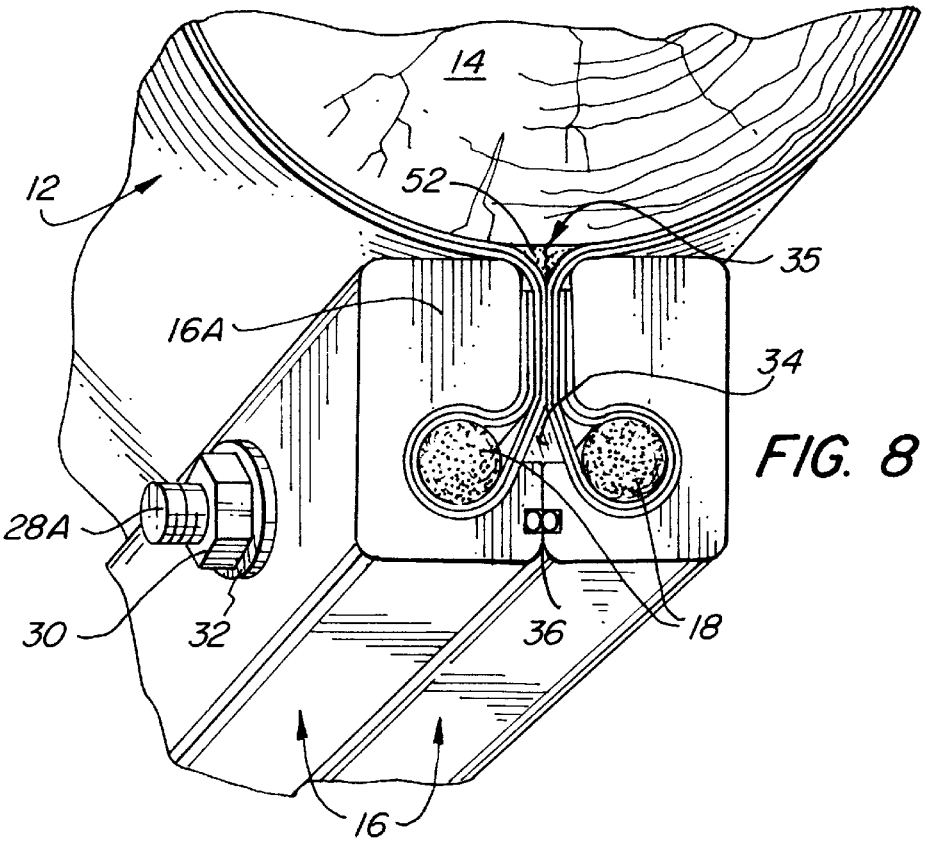
FIG. 8, which is a partial top perspective view of the pile wrapper of FIG. 7.

The nuts 30 are then tightened to draw the clamping bars 16 together, as best shown in FIGS. 1, 6 and 8. Joining the clamping bars 16 in this fashion stretches the pile wrapper 12 around the pile 14 so that the pile wrapper is stretched in length between 1% and 15% and squeezes out any water between the pile 14 and pile wrapper 12. Also, the stretching of the pile wrapper 12 around the pile 14 spreads the anti-corrosive gel evenly around the pile 14 to ensure an even seal.

Finally, the clamping bars 16 are clamped together sandwiching the pile wrapper 12 ends between the first inner faces 16C, forming a first cavity 34 between the clamping bars 16 and a second cavity 35 between the sandwiched pile wrapper 12 and the pile 14.

Figure 5:
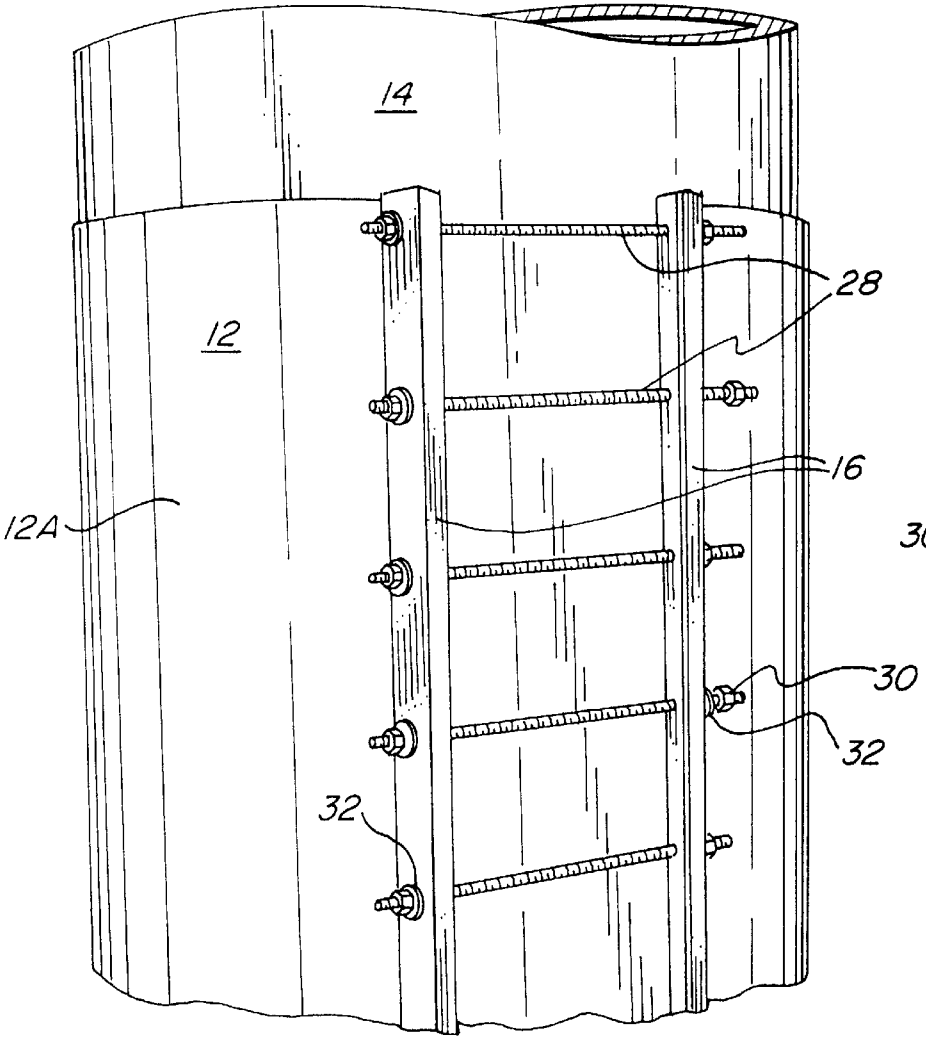
FIG. 5, which is a partial perspective view of the pile wrapper closure assembly of FIG. 1 partially installed on a pile.

Once the clamping bars 16 have been joined together, the draw bolts 28 shown in FIG. 5 may be replaced with shorter clamping bolts 28A, as shown in FIGS. 2, 6 and 8.

Figure 7:
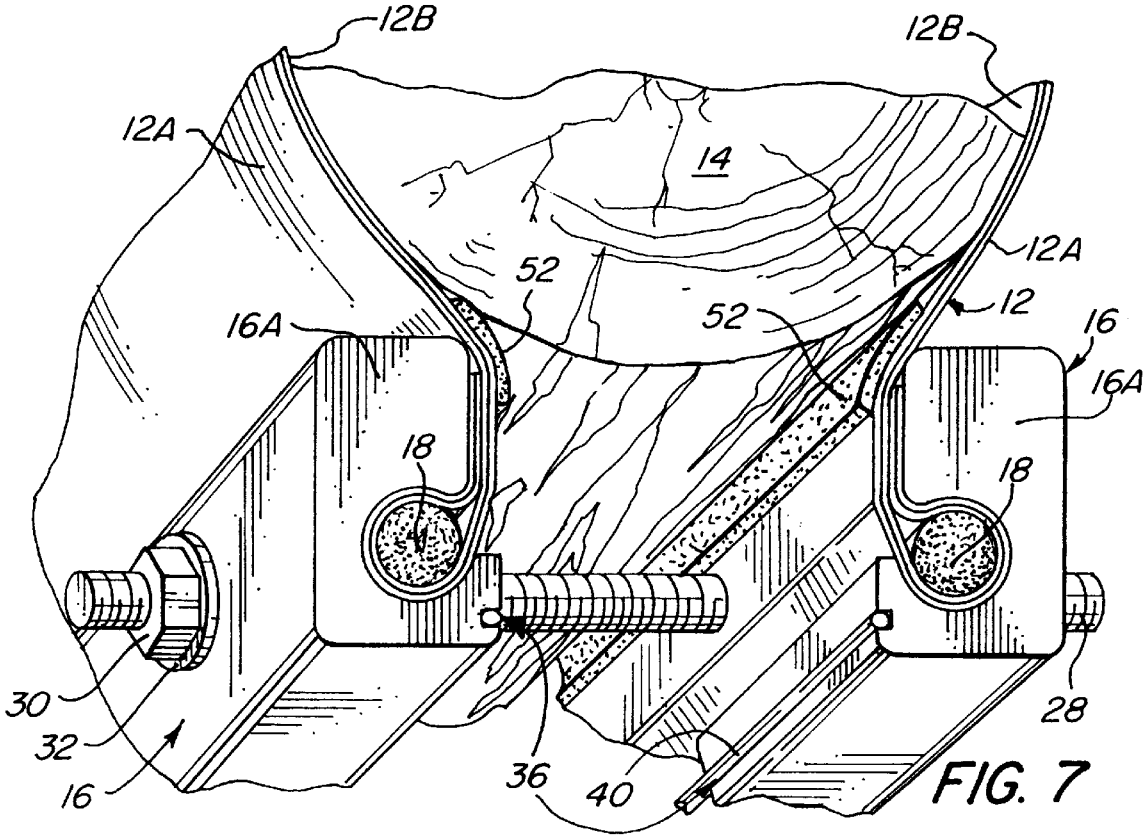
FIG. 7, which is a partial top perspective view of a modified pile wrapper of FIG. 5, showing a modified form of the assembly with a felt strip carrying impregnant bonded to the pile-engaging face of the pile wrapper.

The assembly 10 may also include an optional seal 36 for preventing additional water from seeping between the second inner faces 16D into the second cavity 35. The seal 36 includes a pair of channels 38 and a pair of resilient sealing inserts 40 (FIGS. 4,7). Each channel 38 is located on the second inner face 16D parallel to the retaining grooves 20, is generally rectangular in shape and extends from the first end 16A to the second end 16B of the respective clamping bar 16. Of course, as would be appreciated by one skilled in the art, the channel 38 could be sized and shaped differently so long as the size and shape of the channel 38 is selected to receive the insert 40.

As illustrated in FIG. 7, the size and shape of each insert 40 is selected so that when seated in the corresponding channel 38, each insert 40 protrudes slightly beyond the second inner face 16C of the clamping bar 16. In this manner, the inserts 40 will make contact and compress when the clamping bars 16 are joined together. The inserts 40 may be sized to be force fit into the channels 38 or may be permanently attached to the channel 38 by gluing or other means. In addition, the inserts 40 may be a cylindrical extrusion or "O" ring type seal, and may be made from a variety of materials including cork, rubber, plastic or any other material suitable for forming a watertight and airtight seal.

As illustrated in FIG. 6, with the seal 36 sandwiched between the mated clamping bars 16, the first and second ends 16A,16B of the mated clamping bars 16 may be "capped" on each end 16A,16B, by securing an end cap 42 over the ends 16A,16B of the clamping bar 16, or alternatively, by troweling an epoxy paste (not shown) onto the first and second ends 16A,16B of the clamping bar 16. Above ground "capping" provides an airtight and watertight seal for the ends of the assembly 10. Alternatively, when existing piles are "capped" underwater, water will be trapped in the first and second cavities 34,35. However, the gel inhibitors on the inner layer 12B of the pile wrapper 12, such as modified metal alkyl aryl sulfonates, will neutralize the oxygen in the entrapped sea water thereby preventing corrosion of the pile 12.

In the modified form of the assembly shown in FIGS. 7 and 8, a flexible felt strip 52 is stitched or securely bonded to the inner, pile-engaging face of the wrapper 12 close to the pile side of the draw bolts 28 or clamping bolts 28A, at the inflection points where wrapper 12 bends around the inner pile-side corner of each clamping bar 16. Felt strips 52 are preferably saturated with the water resistant sealant gel incorporating both corrosion inhibiting and biocidal components.

As the clamping assembly is tightened to the clamped condition shown in FIG. 8, both gel-impregnated felt strips 52 are compressed to fill the cavity 35, thereby eliminating a potential point of ingress of seawater, as the volume of the gelled felt before compression is greater than the volume of the void cavity 35.

Figure 9:
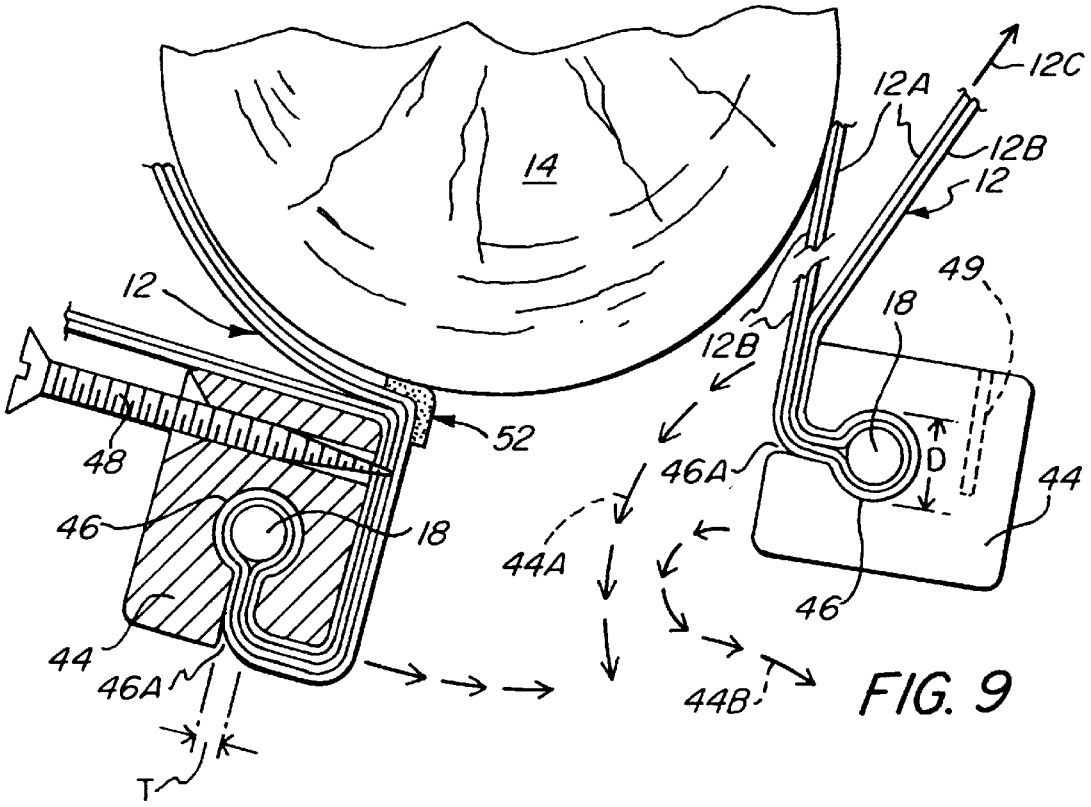
FIG. 9, which is a fragmentary top plan view of a further modified form of the assembly, shown at an intermediate stage in its installation around a pile.
Figure 10:
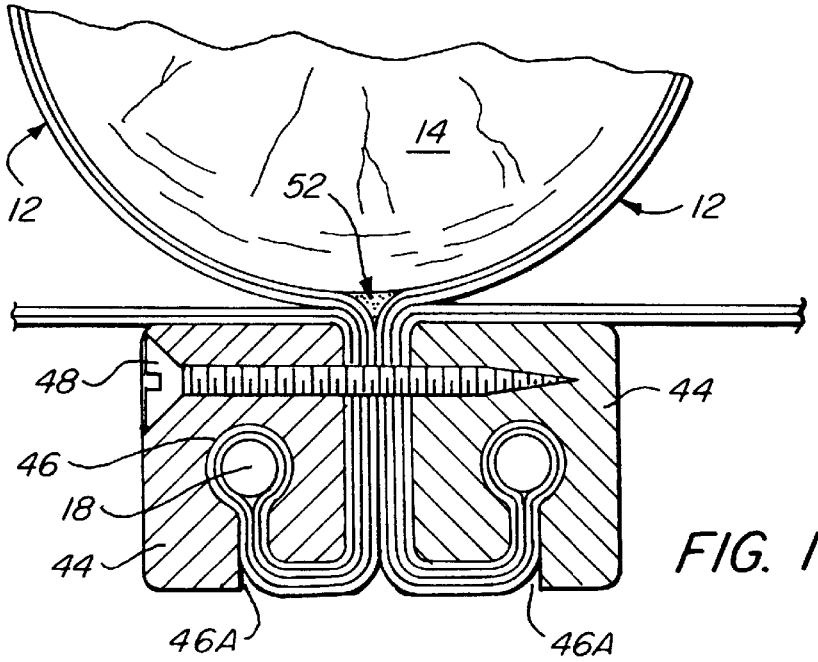
FIG. 10, which is a corresponding fragmentary top plan view, partially in section, showing the modified assembly of FIG. 9 in its permanent, fully-installed condition.

In the further modified form of the clamping assembly shown in FIGS. 9 and 10, generally rectangular clamping bars 44 are provided with retaining grooves shaped as keyhole end slots 46, with their narrow throat openings 46A facing outward, away from the pile 14. Like retaining grooves 20, these retaining grooves 46 may be of any shape but are preferably circular in cross-section, dimensioned to accommodate a layer of pile wrap 12 (normally having outer skin 12A bonded to inner gel-impregnated layer 12B) wrapped around a retaining rod 18. Their throat openings 46A, like openings 20A shown in FIG. 2A, are smaller in width than groove 46, and are just wide enough to accept two layers of wrap 12, as shown in FIGS. 9 and 10, with sufficient clearance to permit the wrap 12, drawn from the pile 14, to be inserted enclosing rod 18 into groove 46, and thence drawn back between its bar 44 and itself toward pile 14 (FIG. 9). This leaves the free end of wrap 12 extending outward, between the right hand clamping bar 44 and pile 14, in FIG. 9, positioned for sliding adjustment in groove 46, stretched by a tension force 12C directed away from right hand bar 44, permitting the installer to advance this bar 44 toward force 12C along wrap 12, or to move it away from force 12C toward its mating clamping bar 44 along wrap 12. When positioned for the desired clamping tension in the wrap 12 embracing the pile 14, the right hand bar 44 is then rotated counter clockwise, as suggested by the curved arrows 44A and 44B, wrapping the double layers of wrap 12 around three right angle corners of bar 44 (FIG. 10), where sliding friction anchors the wrap. This allows the user to adjust the length of the wrap on site to accommodate tapered wood pilings.

A gel-saturated compressible felt strip 52 is also shown in FIG. 9, anchored on wrapper 12 facing the pile 14 at the first inflection point where the wrapper embraces the left clamping bar 44.

In the clamping position shown in FIG. 10, a long self-tapping screw 48 is factory-installed in and almost protruding from the left hand bar 44, and is aligned with and ready to be threaded into an undersized pilot hole 49 in the other bar 44, securing both bars 44 joined together in the clamped position shown in FIG. 10. This installation technique is useful for divers wrapping pilings underwater, where visibility may be near zero, and manipulating the components may require reliance on touch and feel.

As would be appreciated by one skilled in the art, the pile wrapper closure assembly 10 of the present invention is easily used with existing piles, which may be either underwater or aboveground. In addition, the assembly 10 provides for the easy removal and reinstallation of a pile wrapper 12 from a pile 14 providing for periodic inspection of the underlying pile 14. Consequently, the pile wrapper closure assembly 10 of the present invention is easily adjustable, is reusable and removable while providing a watertight seal on any shape or size pile 14.

Although the present invention has been described and discussed herein with respect to one or more embodiments, other arrangements or configurations may also be used that do not depart from the spirit and scope hereof.

What is claimed is:

1. A pile wrapper and closure assembly for joining first and second ends of a flexible pile wrapper so as to secure the pile wrapper to a pile and prevent exposure of the pile to air or water, said pile wrapper closure assembly comprising in combination with said flexible pile wrapper a. a first clamping bar having a first end, a second end and a first substantially cylindrical retaining groove extending from said first end to said second end;

b. a first retaining rod adapted for slidable engagement with said first retaining groove for securing the first end of the pile wrapper to said first clamping bar;

c. a second clamping bar having a first end, a second end and a second substantially cylindrical retaining groove extending from said first end to said second end;

d. a second retaining rod adapted for slidable engagement with said second retaining groove for securing the second end of the pile wrapper to said second clamping bar;

e. joining means attachable between said pile and said retaining grooves to said first and second clamping bars for aligning and joining said first and second clamping bars so as to secure the pile wrapper to the pile;

f. wherein said first and second retaining grooves each have a maximum diameter of D and each include a throat opening not facing the throat opening in the other clamping bar, but instead facing away from said pile having a dimension of T, wherein T is smaller than D; and g. wherein each pile wrapper end is drawn between the clamping bars into its retaining groove, around its retaining rod and back between the retaining bars toward the pile, and both ends are anchored in place by said joining means, whereby the first and second ends of the pile wrapper are supported along the entire length of said first and second retaining grooves respectively.

2. The pile wrapper and closure assembly of claim 1, wherein said first and second clamping bars and the pile wrapper include a plurality of spaced apart and aligned apertures and wherein said joining means comprises a plurality of self-tapping screws cooperatively engaged with said aligned apertures.

3. The pile wrapper and closure assembly of claim 1, wherein the pile wrapper is elastically stretchable and wherein the effective length of the pile wrapper is selected to be less than the circumference of the pile, such that the pile wrapper is stretched in length between 1% and 15% when the pile wrapper is secured to the pile and the first and second ends are joined.

4. A pile wrapper and closure assembly for joining first and second ends of a pile wrapper so as to secure the pile wrapper to a pile and prevent exposure of the pile to air or water, said pile wrapper and closure assembly comprising:

a. a first clamping bar having a first end, a second end and a first substantially cylindrical retaining groove extending from said first end to said second end;

b. a first retaining rod adapted for slidable engagement with said first retaining groove for securing the first end of the pile wrapper to said first clamping bar;

c. a second clamping bar having a first end, a second end and a second substantially cylindrical retaining groove extending from said first end to said second end;

d. a second retaining rod adapted for slidable engagement with said second retaining groove for securing the second end of the pile wrapper to said second clamping bar;

e. joining means attachable between said pile and said retaining grooves to said first and second clamping bars for aligning and joining said first and second clamping bars so as to secure the pile wrapper to the pile;

f. wherein the pile wrapper has an inner pile-engaging face coated with a gel corrosion inhibitor active to neutralize oxygen in surrounding seawater to prevent corrosion, and carrying anchored on said face an elongated compressible porous pad saturated with said gel and positioned to be compressed and to fill any void between the pile and the wrapper ends between the clamping bars.

5. The pile wrapper and closure assembly defined in claim 4, wherein the gel corrosion inhibitor is selected from the group consisting of modified metal alkyl aryl sulfonates.

* * * * *

UNITED STATES PATENT AND TRADEMARK OFFICE

CERTIFICATE OF CORRECTION

PATENT NO. : 6,113,313 
DATED : September 5, 2000
INVENTOR(S) : Russell M. Blair and Anthony E. J. Strange It is certified that error appears in the above-identified patent and that said Letters Patent is hereby corrected as shown below:

Column 1,
Line 6, after "Of" -- co-pending -- should be inserted.

Column 6,
Line 29, after "wrapper" -- : -- should be inserted.

Column 7,
Line 11, "and" should be deleted.

Signed and Sealed this

Eleventh Day of November, 2003

JAMES E. ROGAN
*Director of the United States Patent and Trademark Office*